US006182566B1

(12) United States Patent
Kubatzki et al.

(10) Patent No.: US 6,182,566 B1
(45) Date of Patent: Feb. 6, 2001

(54) PRINTER DEVICE AND METHOD FOR PRINTING ON A PRINT MEDIUM

(75) Inventors: Ralf Kubatzki; Wolfgang Von Inten, both of Berlin (DE)

(73) Assignee: Francotyp-Postalia AG & Co., Birkenwerder (DE)

( * ) Notice: Under 35 U.S.C. 154(b), the term of this patent shall be extended for 0 days.

(21) Appl. No.: 09/146,343

(22) Filed: Sep. 2, 1998

(30) Foreign Application Priority Data

Sep. 5, 1997 (DE) ..... 197 40 396

(51) Int. Cl.[7] ..... B41J 47/46
(52) U.S. Cl. ..... 101/93; 101/91; 347/4
(58) Field of Search ..... 101/93, 91; 347/4

(56) References Cited

U.S. PATENT DOCUMENTS

| | | | |
|---|---|---|---|
| 3,877,531 | 4/1975 | Storace et al. . | |
| 4,815,374 | 3/1989 | Remy . | |
| 4,900,905 | 2/1990 | Pusic . | |
| 4,903,954 | 2/1990 | Robertson et al. . | |
| 5,025,386 | 6/1991 | Pusic . | |
| 5,126,753 | 6/1992 | Martin et al. . | |
| 5,200,903 | 4/1993 | Gilham . | |
| 5,257,197 | 10/1993 | Günther et al. . | |
| 5,399,038 | 3/1995 | Clary . | |
| 5,467,709 | 11/1995 | Salomon . | |
| 5,880,747 * | 3/1999 | Bartenwerfer et al. | 347/4 |
| 5,949,444 * | 9/1999 | Geserich et al. | 347/4 |

FOREIGN PATENT DOCUMENTS

| | | |
|---|---|---|
| 40 37 186 | 4/1991 | (DE) . |
| 94 20 734 U | 4/1995 | (DE) . |
| 196 05 014 | 3/1997 | (DE) . |
| 196 05 015 | 3/1997 | (DE) . |
| 0 718 799 | 6/1996 | (EP) . |
| 2 272 401 | 5/1994 | (GB) . |
| WO 85/01915 | 5/1985 | (WO) . |

* cited by examiner

*Primary Examiner*—John S. Hilten
*Assistant Examiner*—Charles H. Nolan, Jr.
(74) *Attorney, Agent, or Firm*—Schiff Hardin & Waite

(57) ABSTRACT

In a printer device and method for printing on a print medium with a print head and with a transport device for the print medium, wherein the print head is not moved during printing, a controller is connected to sensors and actuators of a displacement device and the transport device. The transport device and the displacement device are mechanically coupled to a displaceable transport device in the printer device that is controllable by the controller for at least one alternative printing position. The transport device transports the print medium downstream in the alternative printing position during printing. The print medium is transported downstream in the X-direction and orthogonally thereto in the Y-direction, the displaceable transport device is returned into a first printing position with reference to the Y-coordinate of a Cartesian coordinate system when all printing jobs have been processed.

11 Claims, 6 Drawing Sheets

PRINTER DEVICE AND METHOD FOR PRINTING ON A PRINT MEDIUM

BACKGROUND OF THE INVENTION

1. Field of the Invention

The invention is directed to a printer device and to a method for printing on a print medium of the type employable for a number of printing jobs, wherein recording medium such as a letter is supplied to the printer device by a transport device which holds it in a defined position. As used herein, the terms letter, piece of mail or print medium include all types of envelopes or other recording media. Postal matter, file cards, labels or self-adhesive tapes of paper or similar material can be employed as a recording medium. The printer device is particularly provided for printing letters in a postage meter/addressing machine.

2. Description of the Prior Art

Given greater volumes of postal matter, the processing of postal matter such as letters, cards, packages, etc., is usually undertaken by employing two independent printer devices before the delivery to the carrier. The labeling of the postal matter with the address of the consignor and of the recipient generally ensues with a less expensive printer (open system) and independently of the franking. Automatic franking machines print monetary values and therefore must exhibit a high security standard to prevent tampering (closed system). The use of both systems makes the mail processing correspondingly expensive.

German OS 40 37 186 discloses a stand-along addressing printer that works independently of an automatic franking machine. The printout ensues on one or more tapes, such as self-adhesive labels. The mail customers should additionally apply the bar code onto the postal matter in order to be able to automatically sort and distribute mailings. A personal computer containing the address data file is required in order to additionally print the addresses. The Cod data logic (alpha 39) address printer is used in common for the analog writing of the address as well as for the bar code printing, however, franking is not possible with this printer. The device is intended for public institutions such as post offices, etc. Here, the address encoding printer should be coupled with a specific postage meter machine with which the postal matter can be more inexpensively franked. It is uncertain whether the post offices will offer a rebate so that the customers will prefer this system, or whether the customers will continue to utilize a postage stamp for franking mail. A security check is not undertaken when the automatic franking machine is used, to determine whether the intended letter has been correctly addressed or whether another letter, not addressed with the customer's device, is franked. This is because coupling ensues only for the electronic transmission of fee reduction information via interfaces with the automatic franking machine. A check of the letter weight would also still have to be implemented with a scale before the franking. Three difference devices would thus be required, still without assurance that the with the correct postage fee. Moreover, it is not possible to utilize the same printer device for a number of different printing jobs.

German OS 40 18 166 discloses a franking module that prints both data types, i.e. franking data and address data for parts thereof as barcode. This device is arranged in a slot of a slide-in drive module of a personal computer. A detent, up to which the letters are inserted, and a light barrier are provided in the franking module at the end of a delivery chute for the letters. The light barrier activates a holding means for the duration of the printing event that fixes the letter in this position. The printing unit prints vertically downwardly and can be coupled to a tape dispenser for franking the postal matter that deviates from a standard size. A labeling of the letter with addresses and the calling of the franking program by user prompting ensue in conjunction with the personal computer. In the franking, the processor system of the franking module works independently and stores the accounting data. The letter must be introduced in the longitudinal direction into an introduction slot in which, however, only letters having specific, standardized dimensions fit. The device is intended for SOHO employment (soft offices home offices). It is disadvantageous that only letters having a standard size can be labeled and franked in the apparatus and that the printout must ensue on a self-adhesive tape. A high mail volume thus cannot be processed because the printed tapes must be manually glued.

German Utility Model G94 20 734.8 discloses an arrangement for a postage meter machine, wherein a tape with the franking imprint and a second tape with the address can be printed respectively with a separate printer device. The difficulty is thereby avoided of having to move a printer device. The mechanically immobile arrangement of the printer module cannot be arbitrarily adapted to other printing jobs. The tapes must be glued onto a recording medium; this, however, is not recognized as permissible by every mail carrier because tampering cannot be completely precluded.

In all such machines, the print medium is conducted along a printer device and the franking respectively address is printed in one pass.

It is standard to conduct the print carrier along the printer device either lying flat—see, for example, U.S. Pat. No. 5,467,709—or standing on one edge (German PS 25 24 670, U.S. Pat. No. 5,025,386, German PS 196 05 014 and German PS 196 05 015). In any case, it is important that the print medium and the printer device proceed into a defined position relative to one another so that the imprint ensues at the intended location and with adequate quality.

Given horizontal transport, a relatively large seating surface is required in conformity with the largest print medium format being employed, and as a result a correspondingly large standing surface is in turn required for the machines. In the solution according to U.S. Pat. No. 5,467,709, printing is carried out in non-contacting fashion with an ink printer head that is displaceable into a second position in order to print a franking tape. The print head should be moved and thus must be relatively small and light. An ink tank can be arranged directly at the print head and is co-moved with it. If movement to another printing position were to be necessary in order, for example, to print an address, then the ink consumption would be higher and the print head together with the ink tank would have to be replaced more often. The print head must be easily accessible for replacement. Moreover, the print head must be protected against drying out during longer pauses; this, however, is only possible with a cleaning and sealing station that is applied with an exact fit. A third position, which is at a relatively large distance from one of the two printing positions must be assumed for cleaning. Only slow movements are thereby possible. An alternating printing of an address and a franking imprint would be practically possible only at very low speed with such a device.

The letter usually lies against a longitudinal guide plate that includes a conveyor belt. The longitudinal guide plate is provided with a recess adapted to the conveyor belt and with a rectangular recess for the ink print head which has diagonal rows of jets. The conveyor belt, the longitudinal guide plate and the ink print head are arranged over the letter. The letter is conveyed clamped between the driven conveyor belt and resiliently seated pressure rollers. The resiliently seated pressure rollers and a pressure roller resiliently seated in the printing region are arranged under the letter. The spring bias movement of the pressure rollers and of the pressure plate corresponds to the maximum thickness of the letters, which can fluctuate between 0.2 mm and 20 mm. The spring power must be capable of handling the entire weight range of the letters—approximately 20 through 1000 g—and must also allow the letters to lie adequately flat in the region of the recess for the print head. As a result of the clamping, hard parts such as, for example, metal clips in or on documents contained in the postal matter can bulge through the envelope, which leads to the reduction of the distance of the envelope surface from the print head or can even cause damage thereto.

An optimally small distance between the print medium and the ink print head must be adhered to for the non-contacting ink printing method so that splatters have little effect and so that the print medium does not touch the nozzle surface, which would produce smears. The risk of smearing is still present, however, when the letter leaves the region of the recess and then slides along the longitudinal guide plate under forced drive. All of these conditions cannot be adhered to given rapidly changing mixed mail.

German PS 25 24 670 discloses a system for processing outgoing letter mail differing in weight and differing in dimensions, whereby the letters are conveyed on edge along a conveying path. The conveying path has driven roller pairs and a conveyor belt. In the region preceding the franking imprint, the letter is arrested by the conveyor belt operating as a friction belt and is transported over guide rollers to a postage drum or printing drum with a counter-pressure drum. The counter-pressure drum is seated on a movable printing base whose distance from the printing drum can be set in conformity with the thickness of the letter passing through the franking station at the moment. Aside from the fact that printer drums will no longer satisfy the increased demands of the future, the printing base contains a considerable number of moving parts. This requires a correspondingly high energy expenditure in order to overcome the inertia of the masses of the components.

A postage meter machine is also known from U.S. Pat. No. 5,025,386 wherein the letters are conveyed on edge, slightly inclined on a circular conveyor belt. The letters thereby lie against a guide block in which a print window is provided. A thermal printing head is arranged in the printer window so as to be displaceable laterally and in height, with the franking imprint on the letter proceeding line-by-line. The outlay for the adjustment of the thermal print head is substantial. The size of the print window must be adapted to the maximum length and width of the print format. The individual letter is moved up to the print window and is then arrested and pressed against the guide plate or the print window with a pressure plate. The pressure plate is driven by a motor a lever and gear articulation. This is a relatively significant mechanical outlay and the counter-pressure forces which must be exerted for thermal printing are likewise high. After the printing, the letter is released and conveyed further. Clearly, only low letter throughput quotas can be achieved with this intermittent operation. The aforementioned disadvantages when metal parts or other hard parts are contained on the document in the letter again arise due to the clamping.

It is likewise known to incorporate postage meter machines into a system for address and franking printing. For example, U.S. Pat. No. 5,200,903 discloses that address and postage value imprinting be undertaken in a fast printer device, the printer device having two separate print heads or a single print head width, with the entire printing width of the letter being moved correspondingly past the printer device.

Postal machines are also known that, given a non-horizontal letter transport, enable both franking and address printing with two ink jet print heads or with a common ink jet print head behind a guide plate adjustable in position between two recesses (German PS 196 05 014 and German PS 196 05 015). For the version with two ink jet print heads, however, two cleaning and sealing stations and corresponding actuators, sensors, control and ink delivery means must be redundantly implemented.

The mechanism required for the version with one ink jet print head adjustable in position is extremely complicated because, if the sealing is not tightly done, the print head can dry out. Moreover, the problems that were already explained in conjunction with U.S. Pat. No. 5,467,709 can still occur.

SUMMARY OF THE INVENTION

An object of the present invention is to provide an arrangement for a printer device with an ink print head suitable for a digital printing process and to provide a method for printing on a print medium that allow the printing of two print stamp formats at a distance from another. The mechanism for the printer device having an ink print head arranged stationary in a relatively small recess of a guide plate during printing should also be optimally simple. An additional object is to provide such a printer device which can be universally employed for imprints insofar as the printing of other data, so that the printer device is not exclusively useable only for franking and address data.

Inventively, a variable-position transport device is displaced relative to the print head together with the print medium (for example, an envelope). The machine preferably has a non-impact printing process with improved printing technology. A postage meter machine equipped in such a way makes it possible to print a machine-readable imprint or address print in addition to the franking imprint. The print head is not moved during printing, but is merely swiveled around an axis into a predetermined position to a single cleaning and sealing station in the printing pauses, allowing short paths to be achieved.

In the displaceable transport device, a print medium, for example an envelope, proceeds against a (letter) detent on a conveyor belt. The transport means with the aforementioned detent is arranged so as to be displaceable step-by-step for the continuing printing process, and can be driven by trigger electronics.

A mechanical auxiliary device that prevents an unintentional print medium offset or removal of the letter during and between the printing phases before the end of the last printing event interacts with the conveyor belt within the displaceable transport device. The print medium, for example an envelope, is preferably conveyed upright (on edge) on the conveyor belt.

During transport of the print medium through the transport device, a first version of the inventive device having the aforementioned auxiliary device allows guidance of the print medium without clamping and is equally suited for guidance of the print medium along a guide plate that is positively or negatively slanted relative to the vertical (normal) of the reference plane.

A second version of the inventive device utilizes a different embodiment of the aforementioned auxiliary device that is fashioned for guidance while non-mechanical clamping a piece of mail.

In a first version of the printing process the letter can be moved in the transport direction during printing and can be subsequently moved opposite thereto. After a first printing, whereby the printing ensues at a first, predetermined distance from the edge of the print medium, a return of the print medium, particularly of the letter, and a setting for a second printing are undertaken. The second and every further printing process ensues in a second or further predetermined distance from the edge. The print medium thus can be completely printed in further printing events. The sequence of the printout, for example for the internal cost center printing or for printing addresses or a barcode, is programmed for each printing job. The printing job can be selected by menu in a user dialog. In particular, the franking can automatically ensue before or after the printing of a machine-readable code or the recipient address. In a second version of the printing method the letter is moved only in the transport direction but not opposite thereto during printing and thereafter. The printhead is arranged so as to be immobile and is not moved during printing. A sequence of printing jobs can be applying a franking imprint, barcode and address imprint at various positions on the letter. A letter movement is implemented until the franking imprint has been completed, printing of the imprint ensuing column-by-column. Subsequently, another printing position is set by bringing the letter into a corresponding position in order to again print a code or the address column-by-column.

DESCRIPTION OF THE PREFERRED EMBODIMENTS

Figure 1A:
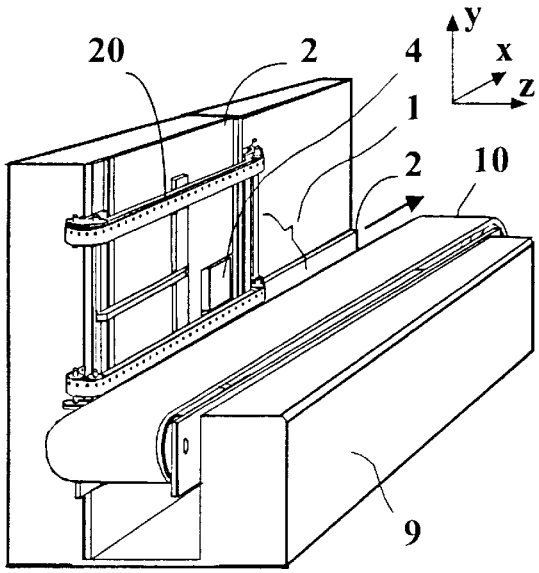
FIGS. 1*a* and 1*b* are perspective views of an inventive printer device in different printing positions, according to a first version.
Figure 1B:
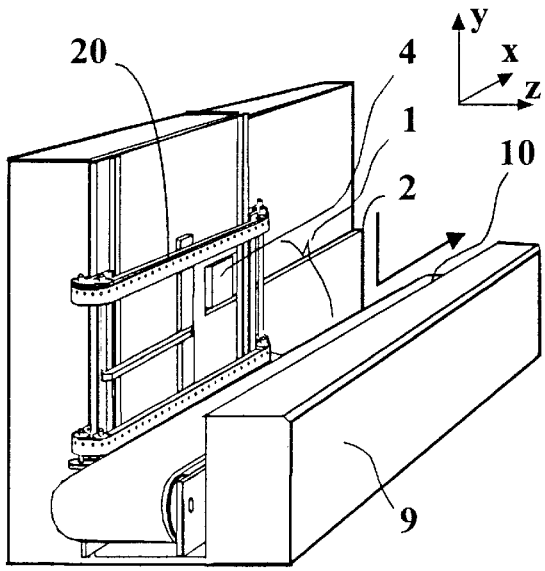

FIGS. 1*a* and 1*b* show perspective views of the inventive printer device according to the first version in two phases for respectively different printing positions. The print head 4 is preferably an ink jet print head and is not moved during the printing process. A guide plate 2 in the housing has a recess for the print head 4. The housing 9 is equipped with a displaceable transport device 1 for pieces of mail that are to be transported. As a result of the displaceable transport device 1, the printer device is suited for different printing jobs, for example for printing franking imprints and/or addressing imprints. The displaceable transport device 1 includes at least one conveyor belt 10 and one auxiliary device 20.

Figure 1C:
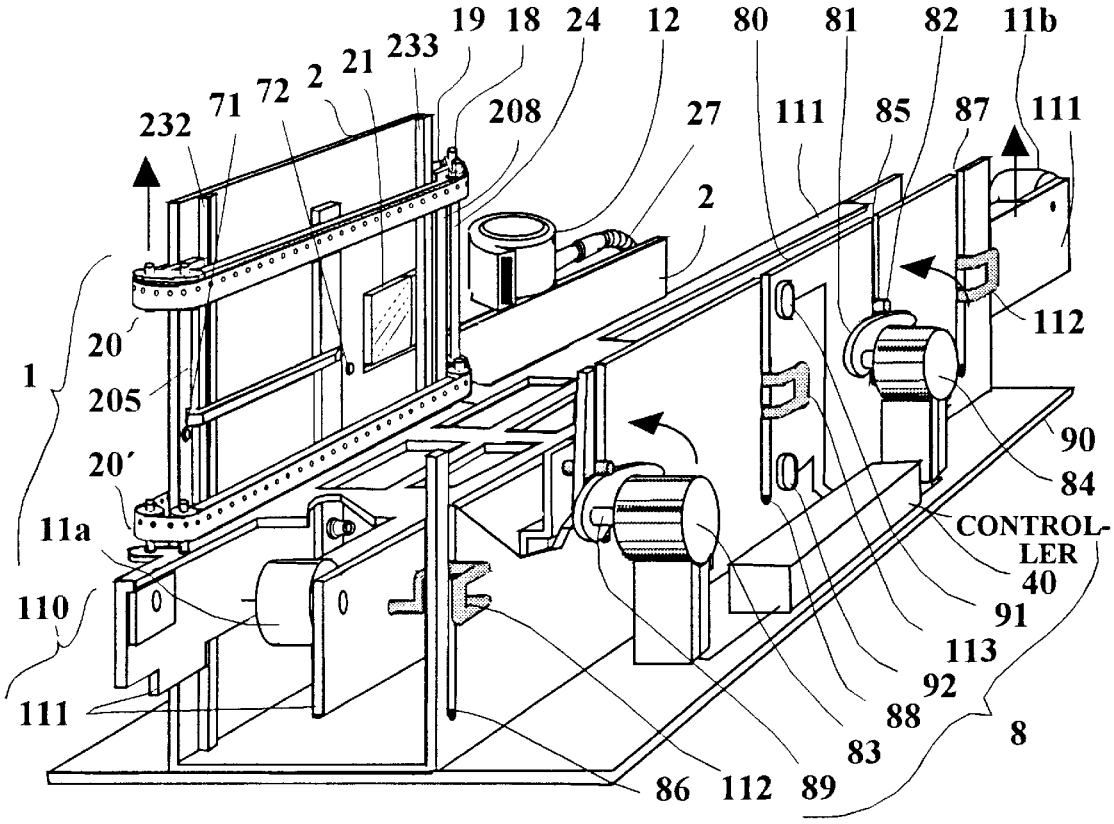
FIGS. 1*c* and 1*d* show details of the inventive printer device.

FIG. 1*c* shows details of the inventive printer device with the displaceable transport device 1 that is shown in an intermediate phase of the transition from a printing position into another printing position.

Figure 1D:
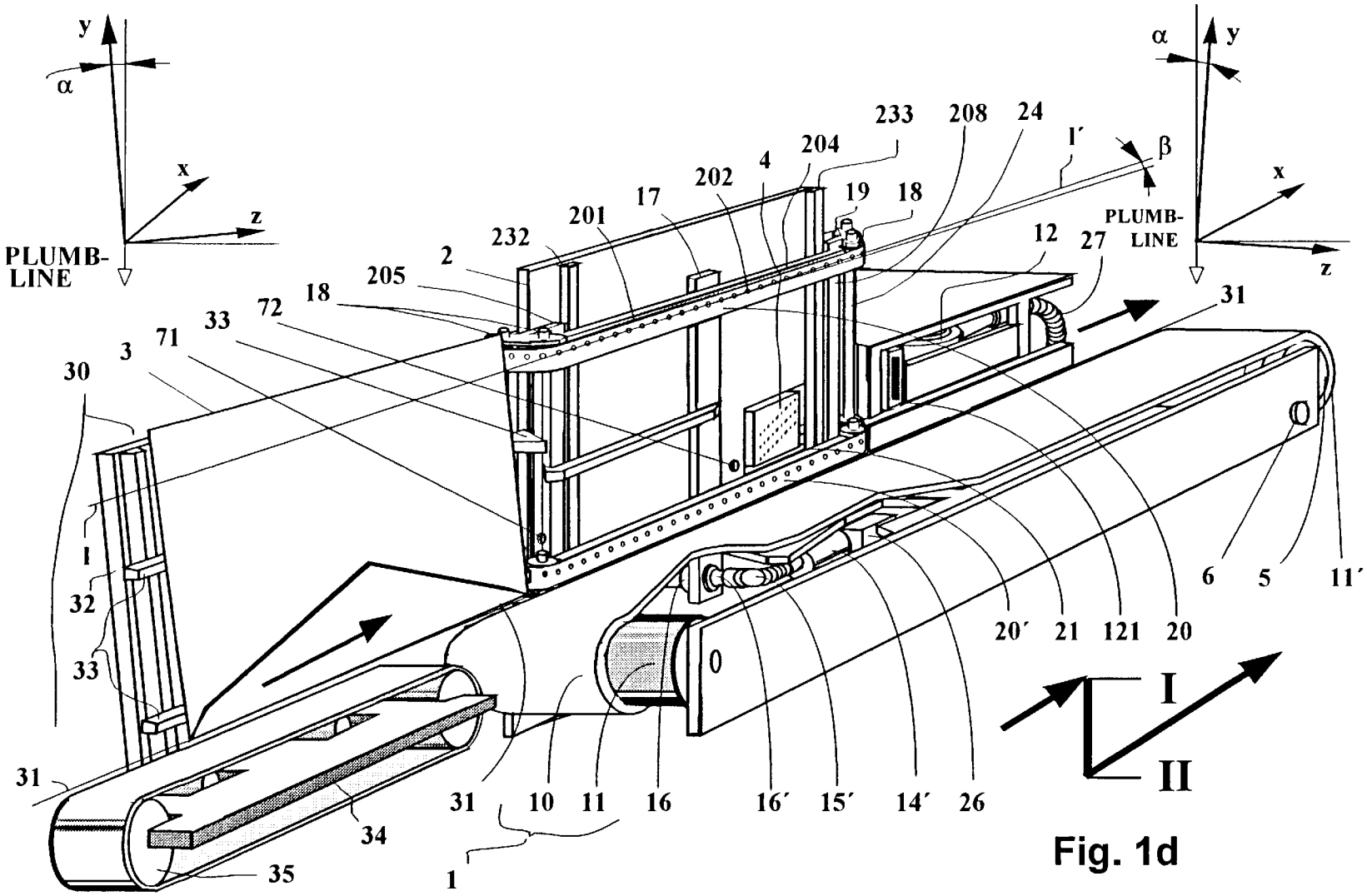

FIG. 1*d* shows a perspective view of the inventive device. The X-axis of a Cartesian coordinate system points downstream, i.e. in transport direction of the print media that have a length in X-direction. The Y-axis of the Cartesian coordinate system points in the direction of the width of the print media that are printed at a region of the X/Y surface. The Z-axis of the Cartesian coordinate system points in the direction of the thickness of the print media 3 whose extent in thickness is limited by the width of the conveyor belt 10. For example, a print medium is an envelope 3. The placed position of the envelope 3—shown at FIG. 1*d*—in an additional, preceding placement device 30 requires the placement of the printing surface of the envelope 3 against a placement guide plate 32. The printing surface is that region of the X/Y surface that is to be printed upon. It is not visible at the introduced envelope 3. The introduced envelope 3 also is upside down and is then conveyed further to the print head 4. During printing in the first printing position 1, the envelope 3 is transported parallel to and past the guide plate 2 in the X-direction. A mechanical displacement of the transport device 1 opposite the Y-direction makes it possible to leave the first printing position I in order to reach a further printing position II.

A controller 40 is connected to sensors and actuators of a displacement device 8 and the transport device 7. The transport device 7 and the displacement device 8 in the printer device are mechanically coupled to the displaceable transport device 1 that can be driven into at least one alternative printing position II by a controller 40, whereby the transport device 7 transports the print medium 3 downstream during printing in the alternative printing position II. The print medium 3 is transported at least downstream in the X-direction and, orthogonally thereto in the Y-direction, the displaceable transport device 1 is reset into the first printing position I with reference to the Y-coordinate of a Cartesian coordinate system when all printing jobs have been processed.

In order to show the details of a version of the displacement device 8 that enables the mechanical displacement of the transport device 1 in the Y-direction, some details of the transport device 1 such as, for example, the conveyor belt 10 have not been shown in FIG. 1*c*.

Standing on a plate 90 functioning as placement surface are the guide plate 2—orthogonally—and a further plate 80 at a distance therefrom that is arranged parallel to the guide plate 2. These aforementioned plates 2, 80, 90 form a chassis for the displaceable transport device 1 and are surrounded by the housing 9 shown in FIGS. 1*a* and 1*b*. Openings or means for the guidance of the displaceable transport device 1 and for the acceptance of the displacement device 8 are formed or provided in the plates 2 and 80. For example, longitudinal openings 85, 86, 87, 88 for coupling members 82, guide members 112 and for a measured value sensor member 113 for determining the phase of the displacement from one printing position to the next printing position are mounted in the aforementioned plates. The displacement device 8 includes at least mechanical parts 81, 82 and a motor 84. The aforementioned means are preferably doubly or trebly utilized in order to be able to undertake the displacement without skewing. A second motor 83 secured to a plate 90 whose axis 89 is arranged perpendicular to the plate 80 can also be seen in FIG. 1*c*. As warranted, a further motor is secured to the plate 90 but is arranged (not visible) behind the guide plate 2. In another version, alternatively, two motors can be arranged behind the guide plate 2 but only one motor in front of the plate 80. The aforementioned mechanical parts 81, 82 and the appertaining motor are coupled to one another via a shaft 89, and possibly a gearing, whereby the motor forces act on the displaceable transport device 1 via a coupling member 82. The aforementioned displacement device 8 can interact with a holder or can be fashioned such that an offset as well as a defined stop in a printing position are produced.

In the illustrated, simplest case, the part 81 is a cam plate and the part 82 is at least one peg-shaped coupling member that slides displaceably in a longitudinal opening 85 of the plates 2 and 80 along an orthogonal direction relative to the plate 90. The displaceable transport device 1 has a frame 110 with lateral plates 111 for the acceptance and drive of the conveyor belt 10 and at least one auxiliary device for guiding pieces of mail 3. The coupling member 82, guide members 112 and an attachment part for the measured value sensor 113 are secured to the lateral plates 111, these being seated with the longitudinal openings 85, 86, 87, 88 in the aforementioned plates 2, 80 of the chassis.

The coupling member 82 of the displaceable transport device 1 slides on the rotatable cam plate 81, the transport device 1 thus being moved opposite the force of gravity. The cam plate 81 is shaped such that an outward curvature allows the resetting of the displaceable transport device 1 into the first printing position I given rotation of the cam plate 81. This phase of resetting is shown according to FIG. 1*c*.

After the first printing position I—shown in FIG. 1*a*—is reached, a franking imprint could be printed, for example, by the printhead 4. The cam plate 81 is shaped such that a further inward curvature allows the displaceable transport device 1 to drop back into a second printing position II upon rotation of the cam plate 81.

For example, an address could be printed in this second printing position II shown in FIG. 1*b*. Given a further rotation of the cam plate 81, the aforementioned outward curvature again produces the resetting of the displaceable transport device 1 into a first printing position I.

The measured value sensor member 113 is a part connected to the displaceable transport device 1 which cooperates with sensors 91, 92 to detect of the position for determining the phase of the displacement of the transport device 1 from one printing position to the next printing position. The measured value sensor member 113 is preferably firmly connected to one of the lateral plates 111 of the frame 110 of the transport device 1. The sensors 91, 92 are arranged on the plate 80 (or alternatively on the guide plate 2) in the immediate proximity of the longitudinal opening 88 for the measured value sensor 113. The controller 40 contains trigger electronics that is electrically connected to the sensors 91, 92 and drives and possibly to further actuators. Motors 11*a* and 11*b* are arranged at the respective ends of the lateral plates 111 in order to affect the transport movement of an envelope or of a similar print medium in the X-direction or oppositely thereto. Alternatively, a single switchable drive can be utilized, for example a d.c. motor 11*a*.

The perspective view of the first version of the inventive apparatus with the displaceable transport device 1 according to FIG. 1*d* shows further details of the printer apparatus; in particular, the conveyor belt 10 and the drive rollers 11, 11' for the motors 11*a* and 11*b* of the transport device 1 are shown. The above-explained parts of the apparatus 8 that enables the mechanical displacement of the transport device 1 have been omitted. The floor space of the machine could stand on a horizontal reference plane having a vertical normal. The displaceable transport device 1 includes an auxiliary device that is arranged at a guide plate 2 inclined negatively or positively relative to the normal of the reference plane. As a result of the auxiliary device, the floor space can also intersect the reference surface at an angle, i.e. the machine can be tilted without negatively influencing the function of the machine. In a preferred, first version of the printer device explained in FIGS. 1*a* through 2*c*, the aforementioned auxiliary device is fashioned for guidance without mechanically clamping the piece of mail, as being explained in detail below.

The displaceable transport device 1 according to FIG. 1*d* includes an auxiliary device at a guide plate inclined negatively relative to the normal of the reference plane, which guides items to be printed without clamping by employing suction to the surface of the print medium. Alternatively, the angle $\alpha$ of inclination can be positive or 0°. In the latter instance ($\alpha$=0°), a vertical letter transport exists. In addition to the first transport and guidance device 20, a further transport and guidance device 20' is provided in the auxiliary device (see FIG. 2*a*). The devices 20 and 20' are inventively arranged at both sides relative to the ink jet print head 4 so that a tautening of the print medium surface 300 to be printed upon ensues. The tautening is possible with the same effectiveness for extremely lightweight print media 3, particularly thin letters, as for thicker print media 3. The aforementioned transport and guidance devices 20, 20' exert suction on parts of the print medium surface 300 at both sides of the region to be printed, with the first transport and guidance device 20 exerting suction on parts of the print medium surface 300 lying remote from the region to be printed and having a guide ascending (rising) in the transport direction. The further transport and guidance device 20' exerts suction on parts of the print medium surface 300 close to the seating edge of the print medium 3 on the surface of the conveyor belt and parallel to the transport direction of the conveyor belt.

Given a negative slope, the inclination of the guide plate 2 is less than 90° relative to the reference plane, and the print medium 3 has a seated position on guide elements of the guide plate 2 that are mounted to the structure that applies suction. In this apparatus, the guide plate 2 can also advantageously assume 90° or a positive inclination relative to the reference plane. In the version at exactly 90°, the guide plate 2 is vertical. Compared to the version with positive slope, a minimization of the friction between the print medium 3 and the other guide elements 23 that have no transport mechanism is achieved. Such other guide elements 23 are, for example, glide rails 231. This positive slope ($0° \leqq \alpha < 10°$) of the zx-plane relative to the reference plane can already be caused by a slanting attitude of the floor space of the machine. An advantage of the invention is that this slanting attitude would have no negative influence on the printing quality.

A negative slope yields the lowest frictional losses and practically no material wear. Such a slanting attitude also facilitates the rotation and the deposit of the pieces of mail after printing, so that the imprint is visible from above after they are deposited. The additional, preceding placement device 30 has a positive inclination compared to the guide plate 2, i.e. the inclination of a placement guide plate 32 shown in FIG. 1*d* is more than 90° relative to the reference plane, and the printing medium 3 already has a reliable placement position at the guide elements of the placement guide plate 32 due to the force of gravity. The placement device 30 preferably has glide rails 33 at the placement guide plate 32 that adapt a positive inclination or vertical to a negative inclination of the guide plate 2. The drive 35 for the transport of the recording medium 3 in the placement device 30 is arranged at a housing part 34. A conveyor belt is preferably utilized; however, no demands are made on the precision of the transport of the recording medium 3 by the placement device 30.

A preceding tape dispenser (not shown) likewise parallel to the placement auxiliary device 30, can be provided to apply a tape to the further transport and guide device 20' which, after the placement, exerts suction on parts of the print medium surface 300 close to the placement edge 31 of the print medium on the surface of the conveyor belt 10 and parallel to the transport direction of the conveyor belt 201. The tape dispenser is preferably constructed as disclosed in German Application 197 12 077.6. If required, it can be adjusted to a positive slope or a vertical position or a negative slope just like the placement device 30.

The transport and guide device 20 of the guide plate 2 with negative slope generates suction to hold the print medium 3 fed thereto by the placement device 30 against the influence of the force of gravity, to initially prevent the print medium 3 from falling over onto the conveyor belt 10. The transport and guide device 20 applies suction initially with a high initial pressure $p_a$ generated by a pump 12, and subsequently produces the tautening during the course of transport as a result of the upward rise of the guide, given an increasing suction area ΣA acting on the print medium surface 300 and simultaneously a decrease in pressure. The pressure p' of the second transport and guidance device 20' of the auxiliary device is not reduced close to the placement edge 31. Advantageously, a slip page of the print medium 3 in the perpendicular direction onto the conveyor belt 10 prevents over-stretching or tearing of the surface to be printed upon. Lifting off of thin print media from the placement edge 31 is likewise reliably avoided and the additional sensor 9 (provided to identify if such a lift off occurs) therefore can be omitted. At the same time, a slip-free movement in transport direction is guaranteed by the interaction with the conveyor belt 10 of the transport device 1.

The recessed region in the guide plate has at least one opening 21 for an ink print head 4, whose nozzle plane is arranged parallel to the guide plate 2. The guide plate 2 or the auxiliary device with the devices 20, 20', 231 are fashioned as a frame following the opening 21 in the transport direction (downstream) so that the print medium 3 is seated in a non-contacting manner at the level of this opening 21 and the drying of the ink dots in the printing region 211 is not impeded.

An arrangement which emits an air stream is provided for promoting a fast drying of the ink. The solvent evaporation is thus accelerated and the evaporating solvent of the ink is quickly eliminated. A blower 121 which emits air stream is preferably a component of the motorized suction pump 12. The air stream is directed onto the surface 300 of the print medium 3. The blowing with the air stream also facilitates separation of the print medium 3 from the guide and the rotation thereof into the desired deposit position.

Figure 2A:
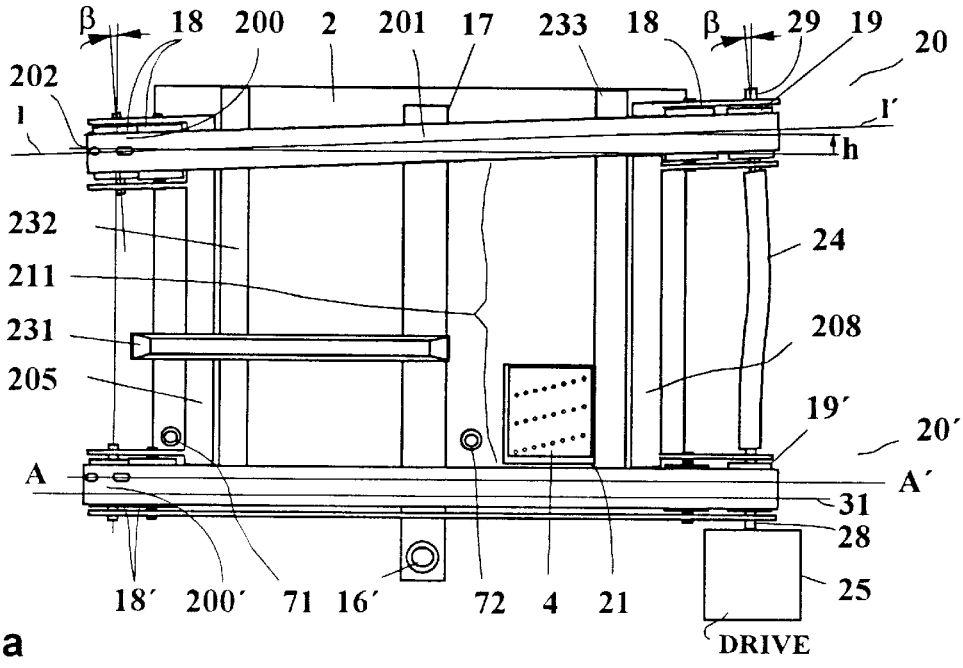
FIG. 2*a* is a side view of an auxiliary device for print medium guidance without mechanical clamping at the guide plate of the printer device according to the first version.

FIG. 2*a* shows a view of the auxiliary device after the guide plate 2 in the first version. The print medium 3 (not shown) has not yet been detected by the sensor 72 and the conveyor belts 201, 201' of the transport and guide devices 20, 20' have not yet been activated and are in the illustrated initial position. One side of each conveyor belt 201, 201' without openings 202, 202' thereby lies in the region between holding rails 205 and 208, and the other sides of the conveyor belts 201, 201' with the openings 202, 202' are disposed outside the aforementioned region behind the guide plate 2. Surfaces 200, 200' of the respective conveyor belts 201, 201' with the openings 202, 202' then lie directly in front of the detection region of the sensor 72. The surfaces 200, 200' of the conveyor belts 201, 201' enter into contact with the surface 300 of the print medium 3 when a placement of the print medium 3 by the placement device 30 (not show here) has been detected by the sensor 72 and the conveyor belts 201, 201' are placed in motion.

Suction is exerted by the transport and guide devices 20, 20' on parts of the print medium surface 300 at both sides of the region to be printed, with the first transport and guide devices 20 having a rise H with respect to the guidance of the suctioned parts of the surface 300 of the print medium 3 between the holding rails 205 and 208 along the line I–I', whereas the further transport and guide device 20' holds the parts of the surface 300 of the print medium 3 in the proximity of the placement edge 31.

The width of the conveyor belt 201' or of the further transport and guide device 20' amounts to a maximum of 8 mm. The opening 21 for the ink jet print head 4 begins at the distance of approximately 9 mm from the placement edge 31 on the surface of the conveyor belt 10. It is thus assured that the application of pressure on the surface 300 of the print medium 3 can begin at a distance of approximately 10 mm from the placement 31. Such a requirement exists, for example, when franking pieces of mail.

The width of the conveyor belt 201 or of the first transport and guide device 20 can vary compared thereto. In the section along the line I–I' through the first transport and guide device 20 of the auxiliary device at the guide plate 2, the structure corresponds to the section through the line A–A' of the auxiliary device.

Figure 2B:
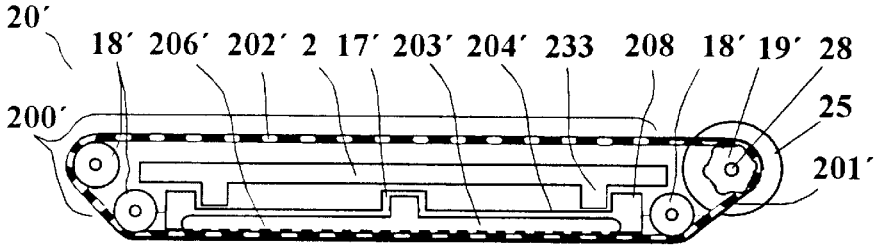
FIGS. 2*b* is a section along the line A–A' in FIG. 2*a* through the auxiliary device at the guide plate according to the first version.

FIG. 2*b* shows a section through the line A–A' of the auxiliary device at the guide plate 2. A drive roller 19' that drives the conveyor belt 201 is secured on the shaft 28 of the drive 25. The conveyor belt 201' is entrained around guide rollers 18' and has a predetermined length, and is in air-tight communication with suction chamber housing 204' via the perforated plate 206' of the transport and guide device 20' of the auxiliary device. The side of the conveyor belt 201' without the openings 202' lies in the region between the holding rails 205 and 208 and closes the suction chamber 203' or the openings of the perforated plate 206' until the conveyor belt 201' is placed by the drive 25 into a synchronous movement relative to the conveying movement of the conveyor belt 10. A shaft 24 connects the shaft 28 of the drive 25 to the shaft 29 of the drive roller 19 for the conveyor belt 201. The two shafts 28 and 29 thereby lie at the angle β relative to one another. The shaft 24 can be fashioned flexibly or as a Cardan shaft.

The conveyor 201' runs around the guide rollers 18' and the drive roller 19' with the same conveying speed as the conveyor belt 10—shown in FIG. 1*b*—as soon as a print medium 3 is detected with the sensor 8. The two drives of the transport device 1 and the auxiliary device are preferably coupled to one another. The drive 25 of the auxiliary device for the drive roller 19' thereby works synchronously with the drive roller 11'. The drive 25 is connected to a controller 40 for this purpose that controls a switch arrangement or clutch.

Figure 2C:
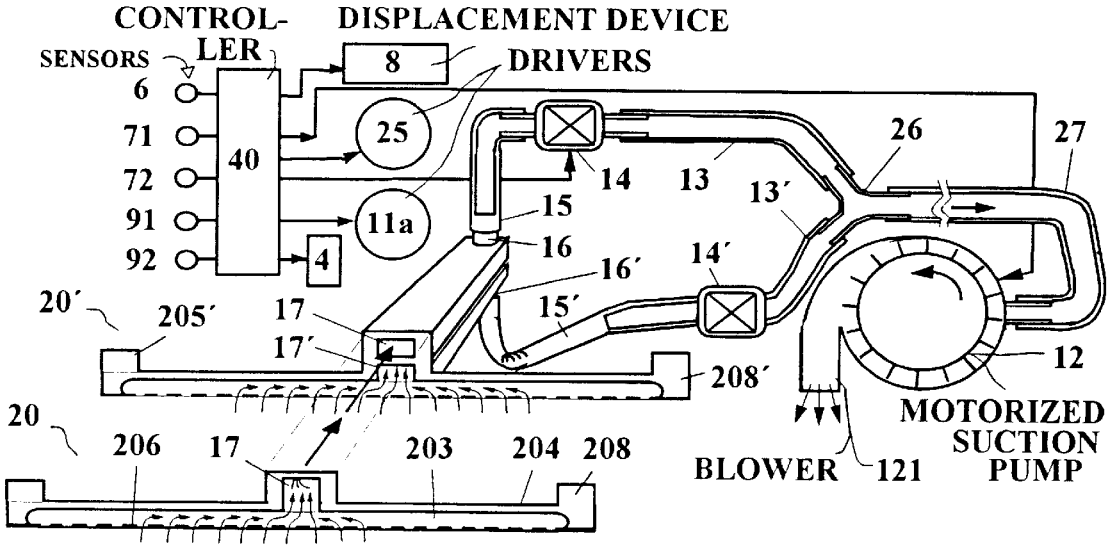
FIGS. 2*c* schematically shows the air guidance arrangement of the auxiliary device and the guide plate according to the first version and the control thereof.

FIG. 2*c* shows a schematic arrangement for air guidance of the auxiliary device at the guide plate 2, and the control thereof. The suction is produced by a suction pump 12 connected with a hose 27 and connector 26 to a pressure hose 13, a controlled valve 14, a pressure hose 15, a connector 16 and the suction channel 17 for the auxiliary device 20. The suction pump 12 is also connected to pressure hose 13', an uncontrolled valve 14', a pressure hose 15', a connector 16' and a suction channel 17' for the auxiliary device 20'. The transport and guidance devices 20 and 20' are equipped with respective suction chambers 203, 203'. Alternatively, a second motor suction pump can be utilized for separately producing suction in the suction chamber 203', in which case the hose connector 26 and the pressure hose 27 to the motor suction pump 12 are not needed.

The controller 40 has an input side connected to the sensors 6 and 71, 72 and 91, 92 and also has an output side connected to the motors or other suitable actuators including drives 11*a*, 25, 83, 84, with the controllable valve 14 as well as with the motor suction pump 12. The drives 11*a* and 25 are preferably DC motors to which the feed voltage is supplied with the required polarity. If an increase in suction occurs which exceeds a predetermined value, the valve 14 draws secondary air from the environment. The size of the predetermined suction valve can be set by the controller 40. The uncontrolled valve 40' draws secondary air from the environment when a magnitude of suction that is permanently set is downwardly transgressed. The permanently suction valve is always greater than the suction valve set for the controllable valve 14. The controllable valve 14 is operated such that the force for overcoming the static friction exerted by the transport and guide device 20 becomes lower and lower as the transport proceeds, so that neither a tearing nor a lift-off of the print medium 3 can ensue, and only the tautening of the surface of the print medium results.

Figure 3:
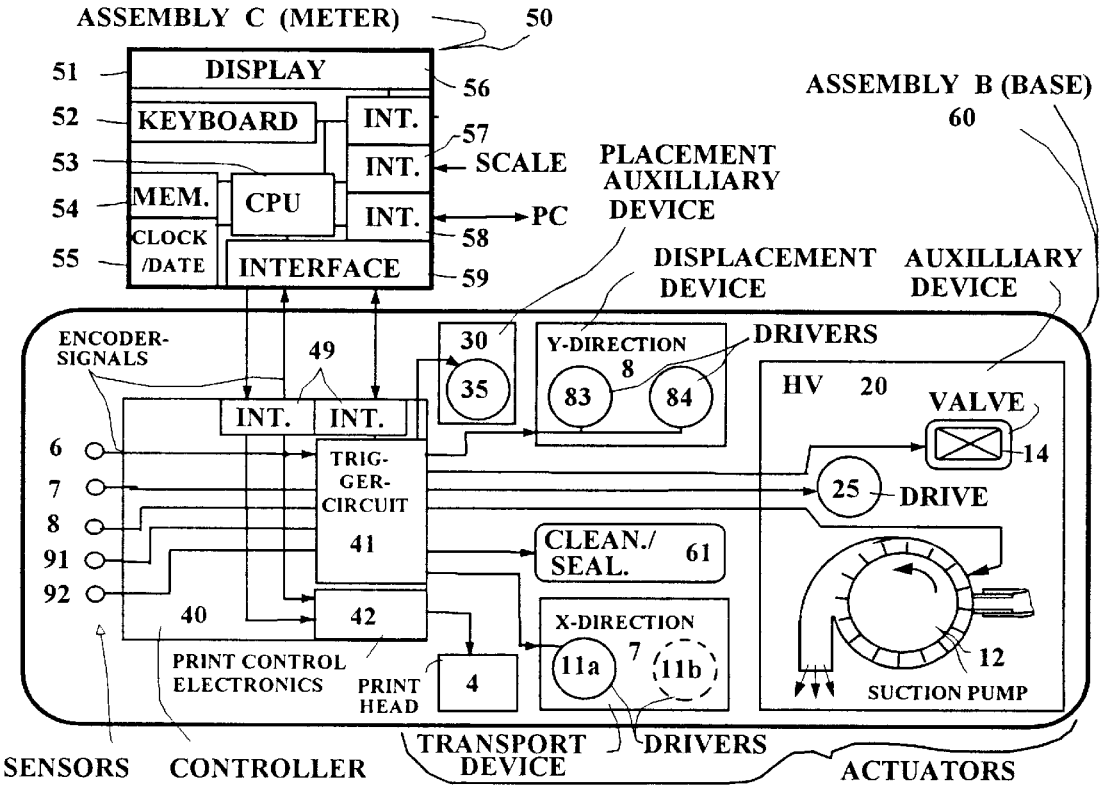
FIG. 3 is a block circuit diagram of an automatic franking unit with the inventive printer device.

FIG. 3 shows a block circuit diagram of an automatic franking unit with the inventive printer device. A first assembly B is known as the base and contains the inventive printer device. A second assembly C contains the meter 50. The base assembly B controls the print head 4 and the conveyor devices 7, 8 with the auxiliary device 20 as well as a cleaning and sealing station 61. The meter 50 contains the central processing unit (CPU) 53, a memory 54 for the program memory, data memory, slogan memory, postal registers, etc., and a clock/date unit 55, an input/output unit 56 with a keyboard 52 and a display unit 51, interfaces 57 for the connection of a scale W and optional serial interfaces 58 for the connection of a personal computer PC as well as a specific interface 59 to the base assembly B.

Figure 6A:
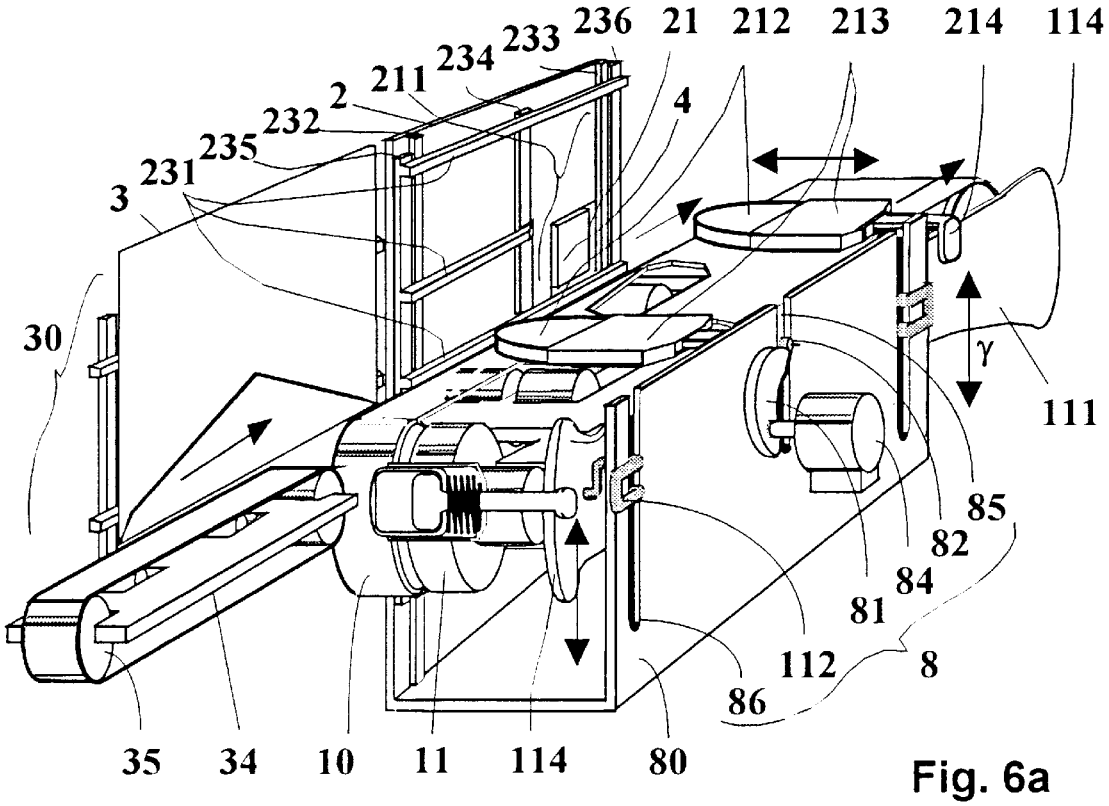
FIGS. 6*a*, 6*b* and 6*c* are perspective views of a transport device with displaceable letter detent and auxiliary device for clamping according to a second version.
Figure 6B:
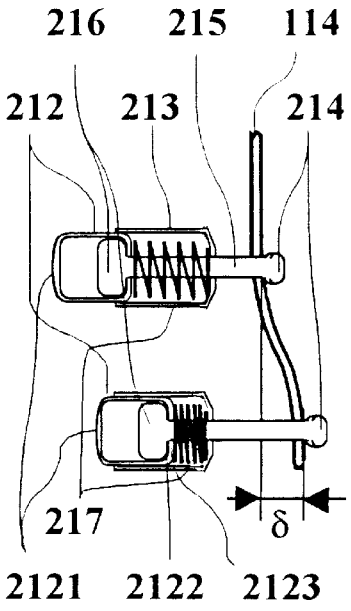
Figure 6C:
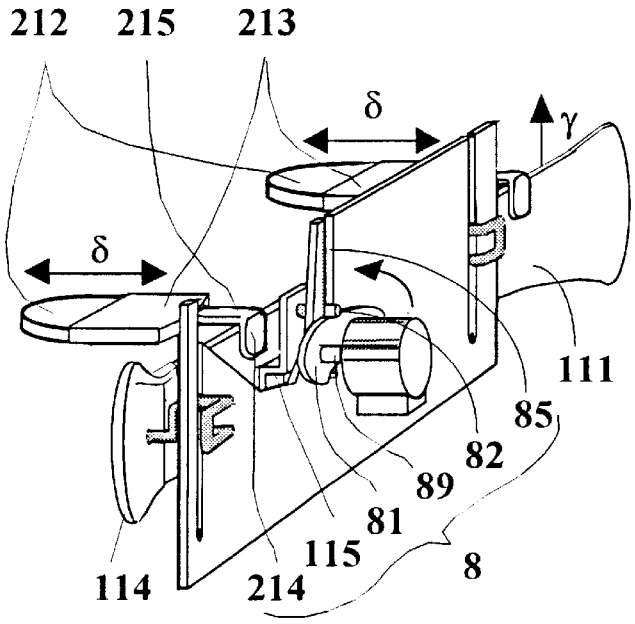

In the controller 40, the assembly B contains a trigger electronics 41 and a print head control electronics 42 for the print head 4 and a power supply and power electronics. The print head 4 is not moved during printing. The encoder 6 supplies an encoder signal to the print control electronics 42, the trigger electronics 41 and the meter 50. The sensors 71 and 72 detect the letter position in the X-direction during letter transport and the sensors 91 and 92 detect the printing position upon displacement of the transport device 1 in the Y-direction by the displacement device 8. The controller 40 controls the displacement device 8 in the Y-direction for the respective printing position, the transport device 7 in the X-direction and, possibly oppositely thereto and matched therewith, and the components 12,14 and 25 of the auxiliary device HV that holds the letter in the applied position at the placement edge 31 of the transport device 1 and preserves it against unintentional, undefined slipping. Alternatively, the drive of the auxiliary device HV can ensue synchronously with the transport device 7 in the X-direction, the positive or negative direction, for example by reversing the polarity of the feed voltage prior to a common drive (FIGS. 6*a*–*c*).

The drive for transporting the recording medium in the X-direction ensues coordinated with the transport motion detected by the encoder 6, which has a slotted disc 5. The trigger electronics 41 triggers the activity of the auxiliary device HV that retains the letter 3 lying against the placement edge 31 and switches the drives of the transport device 1 and displacement device 8. For franking printing, address printing, internal cost center printing, or some other printing job, the CPU 53 of the meter 50 initiates the controller 40 via the trigger electronics 41 and initiates the step-by-step displacement of the placement edge 31 with at least one motor 84 via the aforementioned displacement device 8.

Figure 4:
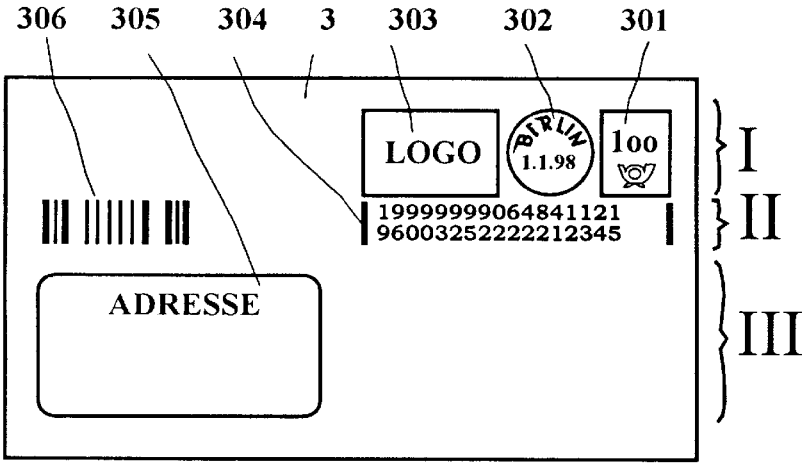
FIG. 4 shows imprints on an envelope made by a printer device according to the invention.

FIG. 4 shows the view of the surface of a completely printed envelope 3. This surface is not visible while lying against the guide plate 2. In the first printing position I, for example, the postmark (franking imprint) 301, the municipality and date stamp 302 and an advertising slogan 303 are successively printed by the print head 4. If the delivery by a governmental mail carrier is requested, an encrypted numerical code 304 or a comparable, machine-readable code 306 can be printed in a second printing position II.

This format, of course, can be completely differently designed. The digital printing method employed can be flexibly adapted to all printing jobs. For example, the address in an address field 305 can be subsequently printed in a third printing position III if necessary.

This method is especially suited for large EIN-A4 envelopes since the distance between two positions is large enough, so that the printing regions I and II need not overlap in the X-direction. A return motion opposite the flow direction can thus be completely emitted.

A window envelope is frequently used for smaller letter formats, so that the addresses can already be printed when printing the letter text, and consequently do not have to be printed out by the inventive device. The printing of a numerical code 304 (which may alternatively be a barcode) that, at the same time, is also an identification of the valid payment of the postage fees that can be checked by a governmental authority has been required by only a few postal authorities. The barcode 306 for an automatic mail distribution, however, can be additionally applied on a window envelope with the inventive method.

It is currently still difficult to economically manufacture dependable ink jet print heads capable of printing over a large printing width with high resolution. Advantageously, the invention requires neither another ink jet print head nor a further printing device for handling such a printing job.

The bar code 306 is of interest for small-format as well as for large-format envelopes and can be printed onto all envelopes at, for example, a second or possibly a fourth position given a relative positioning of the envelope 3 to the print head 4.

Inventively, the second and every further position is achieved by the force of gravity given an approximately perpendicular transport of envelopes. When the aforementioned cam plate 81 is rotated correspondingly farther in the way explained above or when a corresponding barrier is released in comparable displacement means, the letter transport device 1 being held at one position therewith, all envelopes of the same format fall into the new position with the same speed regardless of their weight. The letter is not released by the auxiliary device HV when the conveyor belt drops down. The descent time for 10 cm amounts to approximately 0.15 sec, which allows a maximum processing of approximately sixty print media per minute.

Given only two printing positions, the transport device 1 can be stopped by bumpers when changing position, these being fashioned as rubber bumpers (not shown) in the simplest case against which the side plates 111 of the frame 110 strike. Alternatively, the coupling members 82, that have glide projections sliding in longitudinal openings of the plate 80 and the guide plate 2, can, at predetermined positions, strike bumpers arranged at the circumference of the cam plate 81. Alternative, the coupling members 82 can be seated in shock-absorbing fashion at the side plates 111 via subsections 115, which is advantageous particularly given a number of printing positions.

The advance of the letter movement in the X-direction is decelerated or stopped during the free fall and during the return motion in order to minimize the offset of the printing positions relative to one another in the letter transport direction. The stop time is designed for processing arbitrary print medium formats, i.e. for mixed mail, and suffices in order to intercept any vibrations which may occur briefly when changing position.

As needed, for example when a code 304 is to be printed for verification of the postmark 301, lying directly under the postmark 301, a drive for returning the letter in the transport device 1 into the earlier initial position of the X-coordinates, opposite the initial X-direction, can ensue with a slower motion with the drives 11*b*, 11' in the pauses between the individual printing positions. Alternatively, the drives 11*a*, 11 can be utilized when the drive is, for example, a DC motor.

The letter transport device 1 is moveably arranged at the guide plate 2 so as to be moveable by the force of gravity, i.e. one of the force vectors acts in the vertical direction. The guide plate 2 has an opening 21 for the print head 4. The print head 4 is not moved during printing. The auxiliary device is arranged as a frame around the printing region 211 in order to hold the letter close to the guide plate 2 without impeding the vertical drop of the letter transport device 1 when changing position and without smearing the freshly printed print format. A letter placement edge 31 for every further printing event is arranged so as to be displaceable step-by-step, the displacement device 8 being controlled by the trigger electronics 41.

The displacement device 7 allows transport of the print medium 3 in two opposite directions with which, following a delivery to the first printing event, a manual or automatic return of the print medium 3 into the initial position with respect to the X-coordinate ensues before every further printing event on the same print medium 3. It is advantageous that the auxiliary device HV prevents the premature removal of the print medium 3 and does not release the print medium 3 until after the end of the last printing event.

At least one further sensor (not shown) is connected to the controller 40 in order to control the cleaning and sealing procedure for the ink jet print head 4 in the printing pauses using the cleaning and sealing station 61. To that end, the print head 4 is swiveled into a predetermined position relative to the cleaning and sealing station 61 in the printing pauses, whereby the swivel ensues around an axis lying in the transport direction and the sealing cap of the cleaning and sealing station 61 is then moved toward the print head 4. Since the print head does not change its position, only a single station 61 is required, and this is always in the proximity of the print head 4 regardless of the print jobs to be handled at the moment, and can be reached as needed. A suitable cleaning and sealing station is disclosed in the German Application 197 26 643.6-2.

Other sensors in further stations in front of the base B or downstream can likewise be connected if necessary in order to match the controls to one another. Light barriers are preferably utilized as sensors. A letter detent sensor can be omitted given an approximately vertical letter transport on the basis of the force of gravity.

A preferred sequence utilizing the invention, after a letter is weighed by a scale, forwarded to the franking unit, and the entry of the destination, automatic generation of the postal zip code, automatic generation of the corresponding bar code have been undertaken is as follows.

The print medium 3 is transported in a first direction, i.e. in the X-direction, and printing takes place during the transport in a first printing position.

A first displacement of the print medium placement edge takes place in a second direction opposite the Y-direction for the implementation of a second printing job.

The recording medium 3 is returned into the initial position before the printing by transporting the print medium 3 in a second direction and setting an apparatus routine for the second printing event.

The print medium 3 is transported in the first direction, i.e. in the X-direction, and printing takes place during transport in a second printing position.

A second displacement of the print medium placement edge takes place in the second direction opposite the Y-direction, for implementation of a further printing job.

The print medium 3 is transported in the first direction, i.e. in the X-direction, and printing takes place during transport in a third printing position.

Displacement of the print carrier placement edge takes place in the Y-direction opposite the second direction in order to reach the initial Y-coordinate.

The stopping of the print medium transport that is required before it is returned to the initial position can ensue before, during or after the displacement in the second direction opposite the Y-direction.

A return of print medium 3 opposite the X-direction, i.e. opposite the flow direction, ensues before at least one of the further printing events.

In the routine for an internal cost center printing, a step-by-step displacement of the print medium detent and a return of the print medium to the initial position is provided after a corresponding authorization. A print medium transport in the first direction ensues again subsequently.

Alternatively, the method, given a multi-stage offset, can also include the aforementioned steps in a modified sequence.

The following steps are executed in a second, simplified version of the inventive method, as follows.

The print medium 3 is transported in a first direction, i.e. in the X-direction, and printing takes place during the transport in a first printing position.

A first displacement of the print carrier placement edge takes place in a second direction opposite the Y-direction for the address printing.

The print medium 3 is transported in the first direction, i.e. in the X-direction, and printing takes place during transport in a second printing position.

Displacement of the print carrier placement edge takes place in the Y-direction opposite the second direction in order to reach the initial Y-coordinate.

Figure 5:
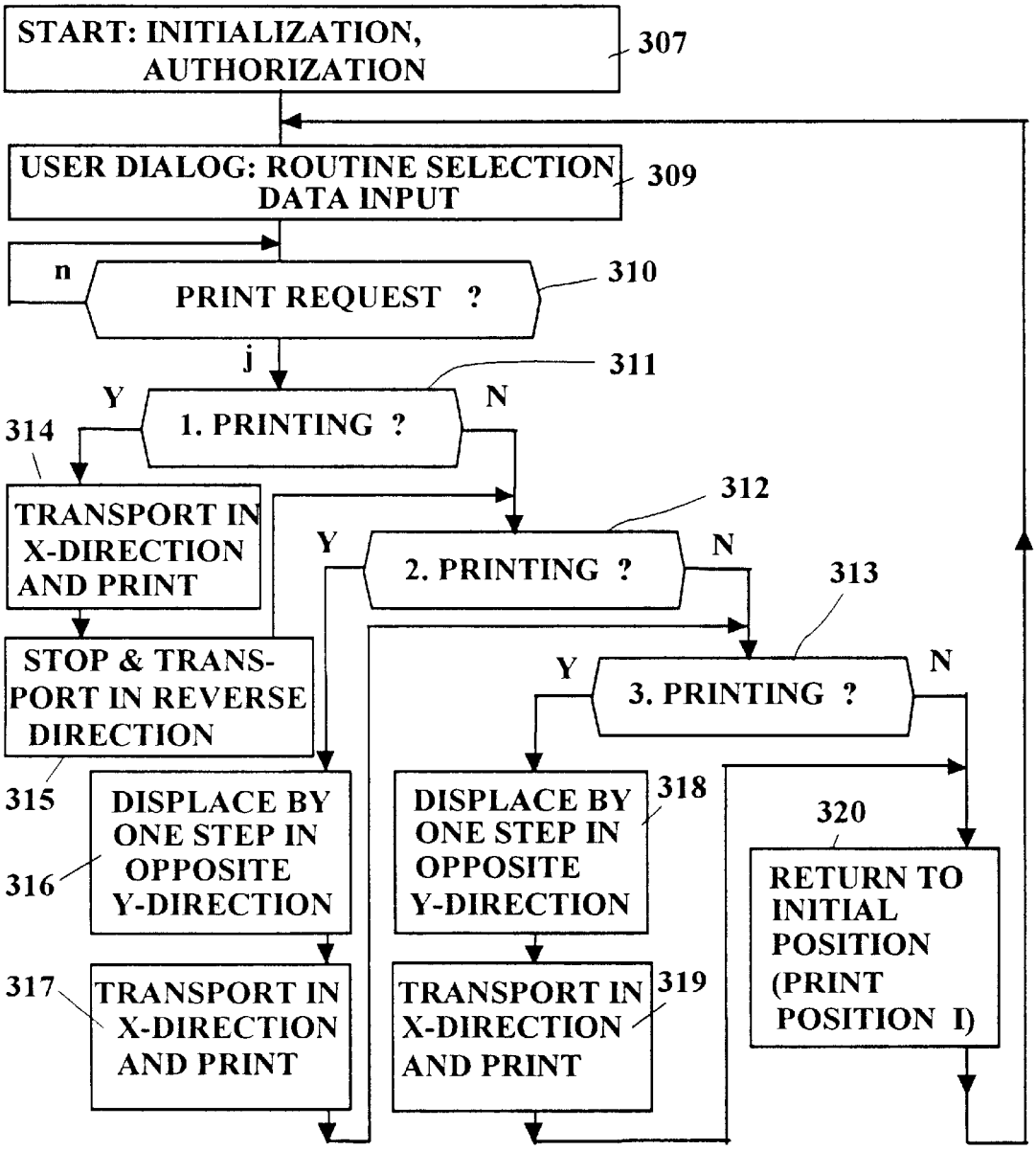
FIG. 5 is a flow chart of a step-by-step displacement of the letter detent given different printing jobs.

FIG. 5 shows an executive sequence of a step-by-step displacement of the print carrier placement edge 31 in a postage meter machine in a further version. After the known starting step 307, which co-covers sub-steps for initialization and authorization of the machine, and after further known steps, a step 309 of user dialog is reached in order to interrogate data on the basis of a manual or automatic data input and to process the data. The routine is in the form of a program only in the sequence of principal steps of franking, address printing or cost center printing, this program being present stored in the memory 54 of the postage meter machine 50. The data input for every principal step can ensue automatically from a scale and/or from a personal computer during the implementation of the routine.

When an arriving print medium is detected in an interrogation step 310, which likewise need not be explained in detail herein, a branch to an interrogation step 311 ensues for the first printing job. When the first printing job is still to be carried out, then a branch is made to a step 314 in order to implement the transport of the print medium in the X-direction and to print the corresponding data. Subsequently, a branch is made via an optional step 315 to a second interrogation step 312 for the second printing job. If it is recognized in the first interrogation step 311 for the first printing job that this job is no longer to be carried out, a branch is made directly to the second interrogation step 312 for the second printing job.

In the optional step 315, the transport motion of the print medium 3 is stopped and reversed in direction. The print carrier 3, correspondingly moved back, is now ready for a further printing, whereby a corresponding print format should, for example, appear directly below the postmark. After checking in the second interrogation step 312 for the second printing job, a branch is made to a step 316 in order to displace the transport device 1 by one step opposite the Y-direction. Printing according to the second job then ensues, whereby a transport of the print medium 3 is again undertaken in the X-direction. Subsequently, a branch is made again to the next interrogation step 313. If it is recognized in the second interrogation step 312 for the second printing job that this job is no longer to be carried out, then a branch is made directly to the third interrogation step 313 for attending to the third printing job. The transport device 1 is again shifted by one step (in step 318) and a printing of corresponding data is then implemented on the print medium 3 transported in the X-direction (in step 319).

When all printing jobs are processed, the step 320 is reached wherein the transport device 1 is brought into the initial position corresponding to the first printer position I. A branch is then made back to the step 309.

After possibly making a solvency check, giving authorization, and entering all data and further steps required for the accounting, the invention allows the print medium or letter to be either ejected unprinted given an unauthorized user or to retain the letter given an authorized user with its introduced edge at the letter placement edge 31 until all addresses, bar code and franking data or cost-center data or similar items head have been printed.

Another embodiment of the aforementioned auxiliary device that is fashioned for guidance while clamping a piece of mail is explained with reference to FIGS. 6*a*, 6*b* and 6*c*. FIG. 6*a* shows a perspective view of a transport device with displaceable print medium detent with an auxiliary device for clamping according to a second version. A transport device 1 with an auxiliary device that, arranged on a conveyor belt 10, having elements 212 through 217 for pressing a print medium against the guide plate 2 is disclosed in German Patentschrift 196 05 015. At least one glide rail 231 and seating rails 234, 235, and 236 are inventively added thereto, these being firmly connected to one another as a frame-like and lying displaceably against the guide plate 2 together with the other components of the transport device 1. The guide plate 2 has rails 232 and 233 to which the seating rails 235 and 236 lie are mounted. Seating rails 234, 235 and 236 are firmly connected to the side part 111 at a side of the frame 110 facing toward the guide plate 2. Together with the frame 110, they form a carriage that is glidably seated at or on the rails 232 and 233 of the guide plate 2. The glide rails 231 and seating rails 233, 235 and 236 preferably form a frame having an adequately large cut-out 211 that is larger in Y-direction and has at least twice the size of the opening 21 in the guide plate 2 for the ink jet print head 4.

The elements 212 through 217 of the conveyor belt 10 are moved together with the belt 10 and serve the purpose of clamping the print medium, i.e. for pressing, for example, an envelope against a glide rail 231 of the guide device 23. The guide device 23 in this second version of the displaceable transport device 1 also performs a guide function for the print medium 3 in the X-direction in addition to the clamping function upon displacement in Y-direction, but has no transport function.

The elements 212 through 217 of the conveyor belt 10 are explained in greater detail in FIGS. 6*b* and 6*c*. A pressure element 212 has a pressing surface 2121 facing toward the print medium and has a detent surface 2122 in the opposite direction at which a thickened end 216 of an element 215 acts. The other end 214 of the element 215 is angled downwardly by 90° onto the edge of the side part 111 that has connecting links 114 at its end. These links 114 act via the end 214 of the element 215 on the pressure element 212 such that it is moved away from the guide plate 2. Beyond the ends of the side part 111, a spring element 217 acts on the pressure element 212 such that it is moved toward the guide plate 2. The pressure element 212 has a stop face 2123 for the spring element 217 in this direction that is supported at a guide element 213 that at least partially surrounds the elements 212, 215, 217 and in which the pressure element 212 is slidably seated. Each guide element 213 is secured on the surface of the conveyor belt. The pressure element 212 glides into the guide element 213 when the angled end 214 on the edge of the side part 111, due to the transport motion of the conveyor belt 10, is moved toward the connecting links 114 arranged at the end side. The excursion distance $\delta$ is thereby transmitted via the element 215 onto the pressure element 212 that lifts off from the print medium surface or from the glide rail 213 at the guide plate 2.

In the preferred version, two motors are arranged behind the guide plate 2 but only one motor is arranged in front of the plate 80. The aforementioned mechanical parts 81, 82 and the appertaining motor 84 are again coupled to one another via a shaft 89, and possibly a gearing, whereby the motor forces act on the displacement transport device 1 via a coupling member 82. FIG. 6*a* shows the first printing position I in the phase preceding the displacement.

In the illustrated, simplest case, the part 81 is again a cam plate and part 82 is a peg-shaped coupling member that slides displaceably in a longitudinal opening 85 of the plates 2 and 80 along an orthogonal direction relative to the plate 90. The aforementioned part 82 has a sub-section 115 that may be shaped step-like between the coupling member and the side part 111 in order to enable the gliding of the angled end 214 of the element 215 on the edge of the side part.

The displaceable transport device 1 has a frame 110 with side plates 111 for the acceptance and drive of the conveyor belt 10 and has at least one auxiliary device for guiding pieces of mail 3. The coupling member 82, guide members 112 and an attachment part for the measured value sensor 113 are secured to the side plates 111, being seated with longitudinal openings 85, 86, 87, 88 in the aforementioned plates 2, 80 of the chassis. The coupling member 82 of the displaceable transport device 1 slides on the rotatable cam plate 81, being moved opposite the force of gravity. The cam plate 81 is shaped such that an outward curvature upon rotation of the cam plate 81 allows the resetting of the displaceable transport device 1 into a first printing position I. The frame 110 with the side parts 111 is thereby lifted by an amount y in the Y-direction opposite the force of gravity. Such a phase of the resetting is shown according to FIG. 6*c*.

The aforementioned displacement device 8 can also be fashioned differently from the aforementioned arrangement, but an offset as well as a defined stop in a printing position must always be present.

A clamping auxiliary device HV that prevents premature removal of the print medium 3 and only releases the print medium 3 after the end of the last printing event can also be fashioned alternatively to the aforementioned arrangement. In the simplest case (not shown), the auxiliary device HV is fashioned as a wire strap that is resiliently seated at a side plate 111 of the frame 110 in order to hold the delivered print medium 3 pressed against the moveable carriage that slides along the guide plate 2.

Although various minor modifications might be suggested by those skilled in the art, it should be understood that our wish to embody within the scope of the patent warranted hereon all such modifications as reasonably and properly come with the scope of our contribution to the art.

We claim as our invention:

1. A method for printing on a print medium with a print head, comprising the steps of:

providing a print medium transport device which is displaceable in a Y-direction of a Cartesian coordinate system and in a direction opposite to said Y-direction;

moving said print medium transport device to a first printing position, and completing a first printing job with said print medium whereby the print medium is transported in an X-direction of said Cartesian coordinate system in said first printing position;

displacing said print medium transport device in the direction opposite said Y-direction to at least one further printing position and conducting a further printing job with said print medium, whereby said print medium is transported in said X-direction; and returning said print medium transport device to said first printing position and moving said print medium transport device in said Y-direction after completion of said further printing job.

2. A method as claimed in claim 1 wherein movement of said print medium by said print medium transport device comprises:

moving said print medium in said X-direction and printing a franking imprint if said print medium arrives at said first printing position;

making a displacement of a print medium placement edge in a second direction, opposite said Y-direction for address printing;

moving said print medium in said X-direction and printing said address in said further printing position; and making a return displacement of said print medium placement edge in said Y-direction, opposite said second direction, for returning said print medium transport device to a beginning Y-coordinate at said first printing position.

3. A method as claimed in claim 1 wherein movement of said print medium with said print medium transport device comprises the steps of:

transporting said print medium in said X-direction and printing on said print medium in said first print position;

making a first displacement of a print carrier placement edge in a second direction, opposite said Y-direction, for conducting a second printing job;

returning said print medium to said initial position before conducting said second printing job by transporting said print medium opposite to said X-direction and setting a routing for conducting said second printing job;

moving said print medium in said X-direction and printing on said print medium at said second printing position for completing said second printing job;

making a second displacement of said print medium placement edge in said second direction, opposite said Y-direction, for conducting said further printing job;

moving said print medium in said X-direction and printing on said print medium at a third printing position for completing said further printing job; and displacing said print medium placement edge in the Y-direction, opposite said second direction, for returning said print medium transport device to an initial Y-coordinate at said first position.

4. A method as claimed in claim 3 comprising the additional step of stopping movement of said print medium in said X-direction before making said first displacement of said print carrier placement edge in said second direction.

5. A method as claimed in claim 3 comprising the additional step of stopping movement of said print medium in said X-direction during making said first displacement of said print carrier placement edge in said second direction.

6. A method as claimed in claim 3 comprising the additional step of stopping movement of said print medium in said X-direction after making said first displacement of said print carrier placement edge in said second direction.

7. A method as claimed in claim 1 wherein each printing job has a printing event which is conducted during the printing job, and said method comprising the additional step of, preceding each printing event, displacing said print medium transport device step-by-step to a predetermined position relative to said print head by the force of gravity before conducting said printing event, while simultaneously moving said print medium in said downstream direction.

8. A method as claimed in claim 1 comprising the additional step of moving said print medium in a direction opposite to said X-direction before conducting said at least one further printing job.

9. A printer device comprising:

a print head which is stationary during printing;

a transport device for moving a print medium relative to said print head;

transport means carried on said transport device for moving a print medium in an X-direction of a Cartesian coordinate system;

displacement means carried on a chassis for said displaceable transport device for displacing a print medium in a direction opposite to a Y-direction of said Cartesian coordinate system; and control means for controlling said transport means and said displacement means for moving a print medium from a first printing position to at least one further printing position downstream in said X-direction from said first printing position and displaced from said first printing position in said direction opposite to said Y-direction.

10. A printer device as claimed in claim 9 wherein said transport means comprises means for transporting a print medium on edge downstream during printing, and further comprising auxiliary means for preventing a premature removal of the print medium during printing and for releasing said print medium after completion of a last a printing job, and said transport means comprising means for placing said print medium in a non-contact relation to said print head during printing.

11. A printer device as claimed in claim 10 wherein said auxiliary means comprises means for guiding a print medium without mechanically clamping said print medium.

* * * * *